US011346342B2

(12) United States Patent
Schneider

(10) Patent No.: US 11,346,342 B2
(45) Date of Patent: May 31, 2022

(54) IMPELLER PUMP HAVING DIFFERENT GEOMETRIES OF THE INLET AND OUTLET OPENINGS

(71) Applicant: BioTrans AG, Bütschwil (CH)

(72) Inventor: Fritz Schneider, St. Gallen (CH)

(73) Assignee: BIOTRANS AG, Bütschwil (CH)

( * ) Notice: Subject to any disclaimer, the term of this patent is extended or adjusted under 35 U.S.C. 154(b) by 469 days.

(21) Appl. No.: 15/949,629

(22) Filed: Apr. 10, 2018

(65) Prior Publication Data

US 2018/0291897 A1 Oct. 11, 2018

(30) Foreign Application Priority Data

Apr. 10, 2017 (DE) ..... 10 2017 107 643.3

(51) Int. Cl.

| | |
|---|---|
| ***F01C 5/00*** | (2006.01) |
| ***F03C 2/00*** | (2006.01) |
| ***F03C 4/00*** | (2006.01) |
| ***F04C 2/00*** | (2006.01) |
| ***F04C 15/06*** | (2006.01) |
| ***F04C 5/00*** | (2006.01) |

(52) U.S. Cl.

CPC ..... *F04C 15/06* (2013.01); *F04C 5/00* (2013.01); *F04C 2240/20* (2013.01); *F04C 2250/10* (2013.01)

(58) Field of Classification Search

CPC ..... F04C 15/06; F04C 5/00; F04C 2240/20; F04C 2250/10

USPC ..... 418/153–154, 259; 415/141, 182.1

See application file for complete search history.

(56) References Cited

U.S. PATENT DOCUMENTS

| | | | | |
|---|---|---|---|---|
| 945,953 | A | 1/1910 | Hughes | |
| 2,663,263 | A * | 12/1953 | See | F04C 5/00 418/154 |
| 2010/0226809 | A1 | 9/2010 | Kadaia | |
| 2011/0236241 | A1 | 9/2011 | Diekmann | |

FOREIGN PATENT DOCUMENTS

| | | |
|---|---|---|
| CN | 1596343 | 3/2005 |
| DE | 830161 | 1/1952 |
| DE | 1191231 | 4/1965 |
| DE | 1236340 | 3/1967 |
| DE | 8223151 | 11/1982 |
| DE | 102010062298 | 6/2012 |
| EP | 2646691 | 6/2015 |
| GB | 1059902 | 2/1967 |
| WO | WO 2014/123325 | 8/2014 |

OTHER PUBLICATIONS

DE102010062298A1—Finsterwalder—Impellerpumpe—Jun. 6, 2012—Copy of the English Translation (Year: 2012).*

Extended European Search Report, European Patent Application No. 18166533.2, dated Sep. 5, 2018, 13 Pages.

Chinese Office Action, Chines Patent Application No. 201810315434.9, dated Apr. 19, 2019, 7 pages.

* cited by examiner

*Primary Examiner* — Theresa Trieu

(74) *Attorney, Agent, or Firm* — Haynes and Boone, LLP

(57) ABSTRACT

An impeller pump having a housing, which has an inlet and an outlet, and having an impeller wheel with a plurality of elastic impeller blades is described. The cross section of the inlet and/or of the outlet is substantially in the shape of a polygon on the side facing the housing interior.

20 Claims, 10 Drawing Sheets

IMPELLER PUMP HAVING DIFFERENT GEOMETRIES OF THE INLET AND OUTLET OPENINGS

CROSS-REFERENCE TO RELATED APPLICATIONS

This application claims priority from German Patent Application No. DE 10 2017 107 643.3, filed Apr. 10, 2017 in the German Patent and Trademark Office, the disclosure of which is incorporated herein by reference in its entirety.

BACKGROUND

Technical Field

The present invention relates to an impeller pump having an improved geometry of the inlet and outlet openings.

Related Art

Impeller pumps use an impeller wheel having a plurality of elastic impeller blades (also known as impeller vanes), which rotate in a pump housing. The diameter of the impeller wheel, i.e. the length of the impeller blades, is selected here such that the free end of the impeller blades bears against the inner wall of the pump housing in every position of the impeller wheel. Between the outlet opening and the inlet opening of the pump housing, the distance of the inner wall from the axis of rotation of the impeller wheel decreases. As a result, the impeller blades are bent (to a greater extent) during the movement from the outlet opening to the inlet opening than during the movement from the inlet opening to the outlet opening. As a result, the volume that is delivered from the outlet opening to the inlet opening during a rotation of the impeller wheel is less than the volume that is delivered from the inlet opening to the outlet opening during a rotation of the impeller wheel. This results in the medium to be pumped being delivered from the inlet opening to the outlet opening.

Impeller pumps are particularly suitable for delivering liquids contaminated with suspended solids and fibres—for example containing food waste. A further advantage is that impeller pumps are self-priming on account of the sealing off of the impeller blades from the pump housing.

Since, in order to ensure this sealing off, the impeller blades bear firmly against the inner wall of the pump housing, they are subject to wear. This is exacerbated by the fact that, when they sweep over the inlet opening and the outlet opening, the impeller blades are pushed into these openings, and particularly against the edges thereof, on account of their elasticity and also on account of centrifugal forces.

From the prior art, it is previously known to provide the inlet and/or outlet opening with a grating or "comb" in order to reduce this impact on the impeller blades. However, in the case of liquids containing suspended solids, in particular when the latter contain fibrous constituents, this results in the possibility of the contaminants getting caught on the grating bars, thereby reducing the delivery capacity of the pump. Furthermore, there are hygienic concerns in this case, when the contaminants are located in the pump housing for a relatively long time.

Furthermore, EP 2 646 691 B1 discloses an impeller pump in which the inlet or the outlet is configured in an elliptical manner. As a result, although the depth to which the impeller blades are pushed in can be reduced, on account of the elliptical shape of the inlet or outlet, only some of the impeller blades come into contact with the edge of the ellipse in each case, and so the impeller blades wear down to a greater extent there and thus unevenly, with the possible consequence of leaks.

SUMMARY

Proceeding from the known prior art, an impeller pump that addresses the abovementioned drawbacks of the prior art are resolved.

Accordingly, an impeller pump having a housing, which has an inlet and an outlet, and having an impeller wheel, which is accommodated in the housing interior, with a plurality of elastic impeller blades is described. The cross section of the inlet and/or of the outlet on the side facing the housing interior is substantially in the shape of a polygon in one embodiment.

The inlet and the outlet have an inner inlet opening and an inner outlet opening, respectively, at which they transition in each case into the housing interior, in which the impeller wheel with the plurality of elastic impeller blades (made for example of rubber) is located.

The term "cross section" should be understood herein as meaning that in particular the inlet or the outlet is viewed from the interior of the housing along an axis defined by the inlet or outlet. This means for example that an inlet which is provided by a pipe having a circular cross section has a circular cross section even when the actual shape of the inlet opening in the housing is no longer circular when it is developed onto a plane of the pump housing.

Since the inlet and the outlet are openings, the polygon is usually a closed polygon.

Since the cross section of the inlet and/or of the outlet on the side facing the housing interior is substantially in the shape of a polygon, when an impeller blade moves over the inlet or outlet, even sweeping of the impeller blade over the edges of the inlet or the outlet can be achieved. In other words, the contact point between the impeller blade and the respective edge of the inlet or outlet is shifted substantially evenly, such that more even wearing down of the impeller blades occurs and thus a longer lifetime of the individual impeller blades and thus a longer service life of the impeller wheel is achieved.

The polygon can, in various embodiments, have a number of from 3 to 17 corners.

The shape of the cross section of the inlet and of the outlet can be the same or different.

In another embodiment, the polygon has a longitudinal extent and a transverse extent, wherein the ratio of the length of the transverse extent to the length of the longitudinal extent is less than or equal to 1:2, for example about 1:3 or about 1:4. As a result, with the same inlet or outlet cross-sectional area, the width of the inlet or outlet opening is correspondingly smaller, and so it is also the case that only a correspondingly narrower section of the impeller blades does not come into contact with the housing wall during the movement over the inlet or outlet opening. As a result, the impact on the impeller blades by deformation decreases correspondingly, when the latter are moved over the inlet or outlet opening.

The term "longitudinal extent" should be understood herein as meaning the maximum length of the cross section and the orientation thereof. The term "transverse extent" describes a maximum width, oriented differently from the orientation of the longitudinal extent, of the cross section.

In various embodiments, the shape of the inlet or outlet is configured such that the longitudinal extent and the transverse extent are formed substantially perpendicularly to one another.

In order to achieve even wearing down of the impeller blades during the movement of the impeller blades over the inlet or outlet opening, and in order to achieve uniform flow conditions in the regions between the impeller blades and in the inlet and/or outlet, in an additional embodiment, the polygon is configured in a symmetrical manner with respect to the longitudinal extent and/or is configured in a symmetrical manner with respect to the transverse extent.

In certain embodiments, the ratio of the length of the transverse extent of the polygon to the width of the impeller blades is less than 1:1, for example less than or equal to 1:2, or about 1:3 or about 1:4. In this way, it is possible to ensure that a sufficiently large part of the impeller blades is always in contact with the housing wall on sweeping over the inlet or outlet opening. As a result, deformation of the impeller blade as a result of the passing into the inlet or outlet opening is limited. In addition, good sealing off between the housing wall and the little-deformed impeller blade is always ensured. The polygon is in this case typically oriented such that the longitudinal extent extends in the direction of movement of the impeller blades.

In some embodiments, the polygon has at least one rounded corner, wherein generally all the corners of the polygon are rounded. This results in more uniform flow conditions during pump operation.

In several embodiments, the cross section of the inlet and/or of the outlet on the side facing away from the housing interior is substantially in the shape of a circle or the shape of a polygon, for example of a rectangle, and in some embodiments, of a square. This makes it possible to attach the impeller pump described here to conventional pipelines or fit it into special arrangements.

Generally, the area of the associated cross section on the side facing the housing interior and the area of the associated cross section on the side facing away from the housing interior differ substantially by less than 10%, and they are typically substantially the same size. This allows a uniform inlet into the pump or outlet out of the pump, since the medium to be delivered cannot back up at a constriction, or turbulence cannot develop on account of a large increase in cross section.

Alternatively, the area of the associated cross section on the side facing the housing interior and the area of the associated cross section on the side facing away from the housing interior can differ, for example by 15%-75%, by 30%-60%, or by about 50%. In this way, a cross section with a particularly small or short transverse extent can be employed, such that the impeller blades are correspondingly deformed and worn only a little.

An impeller pump having a housing, which has an inlet and an outlet, and having an impeller wheel, which is accommodated in the housing interior and rotatable about an axis of rotation, with a plurality of elastic impeller blades is described. The cross section of the inlet and/or of the outlet on the side facing the housing interior has a longitudinal extent and a transverse extent, wherein the length of the longitudinal extent is greater than the length of the transverse extent. The longitudinal extent encloses an angle with the axis of rotation.

Since the longitudinal extent encloses an angle with the axis of rotation, more even wearing down of the individual impeller blades is achieved. The impeller blade does not, as in conventional impeller pumps, come into contact symmetrically with the edge of the inlet or outlet opening in each case at the same points of the impeller blades before and after sweeping over the middle of the inlet or outlet opening. Rather, the blade sweeps over the inlet or outlet opening in a substantially uniform progression from one side of the impeller blade to the other side of the impeller blade.

In other words, the contact point of the impeller blade shifts on moving past the inlet or outlet opening in the transverse direction to the direction of movement of the impeller blades. At the same time, the maximum width with which the individual impeller blades do not come into contact with the housing wall in each case is still relatively small on account of the greater longitudinal extent compared to the transverse extent, and so still only little deformation of the impeller blades and reduced passing of the impeller blade into the inlet or outlet opening occurs.

The term "angle" should be understood here as being the angle which forms when the cross section between the longitudinal extent—or possibly the elongation thereof—and the axis of rotation is seen in plan view. In other words, in order to determine the angle, the axis of rotation of the impeller wheel should be projected onto a plane defined by the cross section. The angle corresponds then to the angular dimension between the longitudinal extent and the projection of the axis of rotation.

The orientation of the longitudinal extent may be different for the inlet and the outlet, but may also have the same orientation.

Generally, in this case, the angle is greater than 0° and less than 90°, for example greater than or equal to 15° and less than or equal to 75°, greater than or equal to 30° and less than or equal to 60°, or about 5°, 10°, 15°, 20°, 25°, 30°, 35°, 40° or 45°.

In a further embodiment, the cross section is substantially in the shape of an ellipse or polygon.

In order to further adapt the flow conditions during pumping, in various embodiments, the polygon has at least one rounded corner, wherein typically all the corners are rounded. If the polygon is in the shape of an elongated rectangle, the radii of the roundings in this case correspond generally to half the width of the rectangle, and therefore they are then selected such that an oblong hole is formed.

In several embodiments, the ratio of the length of the transverse extent to the width of the impeller blades is less than 1:1, for example less than or equal to 1:2, or about 1:3 or about 1:4.

In order to keep the deformation of the impeller blades as the impeller blades move over the inlet or outlet opening low, the ratio of the length of the transverse extent to the length of the longitudinal extent is, according to some embodiments, less than or equal to 1:2, for example less than or equal to 1:3 or about 1:4.

In certain embodiments, the ratio of the width of the impeller blades to a cross-sectional width parallel to the width of the impeller blades is greater than or equal to 3:2, for example greater than or equal to 2:1. As a result, the deformation of the impeller blades on moving over the inlet or outlet opening can still be kept low.

In several embodiments, the cross section of the inlet and/or of the outlet on the side facing away from the housing interior is substantially in the shape of a circle or the shape of a polygon, for example of a rectangle, and in some embodiments, of a square, wherein generally the area of the cross section on the side facing the housing interior and the area of the associated cross section on the side facing away from the housing interior differ substantially by less than 10%, and are typically substantially the same size. Alternatively, the area of the associated cross section on the side facing the housing interior and the area of the associated cross section on the side facing away from the housing interior can differ, for example by 15%-75%, such as by 30%-60% or by about 50%. As a result, the abovementioned advantages are achieved.

In additional embodiments of the abovementioned impeller pumps, at least one edge of the inlet and/or of the outlet has a chamfer or is rounded at the transition to the housing interior, wherein typically all the edges of the inlet and/or of the outlet have a chamfer or are rounded at the transition to the housing interior. As a result, the pressure which is applied to the impeller blade by the edge on account of the deformation and the pressure force of the impeller blade is reduced. This also results in smooth pressure-point progress on the impeller blade. It is also possible here for at least one edge to be rounded and for at least one other edge to have a chamfer.

In other embodiments of the abovementioned impeller pumps, the transition of the inner wall of the housing from a region with a maximum diameter to a region with a reduced diameter coincides substantially with the transverse extent of the cross section of the inlet or outlet opening. In this case, this transition does not take place abruptly, but the distance of the housing inner wall from the axis of rotation of the impeller wheel decreases continuously from the maximum distance, at which the impeller blades are not bent or are bent to the least extent, to the minimum distance, at which the impeller blades are bent to the greatest extent.

BRIEF DESCRIPTION OF FIGURES

Further embodiments are explained in more detail by the following description of the figures, in which.

DETAILED DESCRIPTION

Exemplary embodiments are described in the following text with reference to the figures. Here, identical, similar or identically acting elements are provided with identical reference signs in the different figures, and a repeated description of these elements is to some extent dispensed with in order to avoid redundancies.

Figure 1:
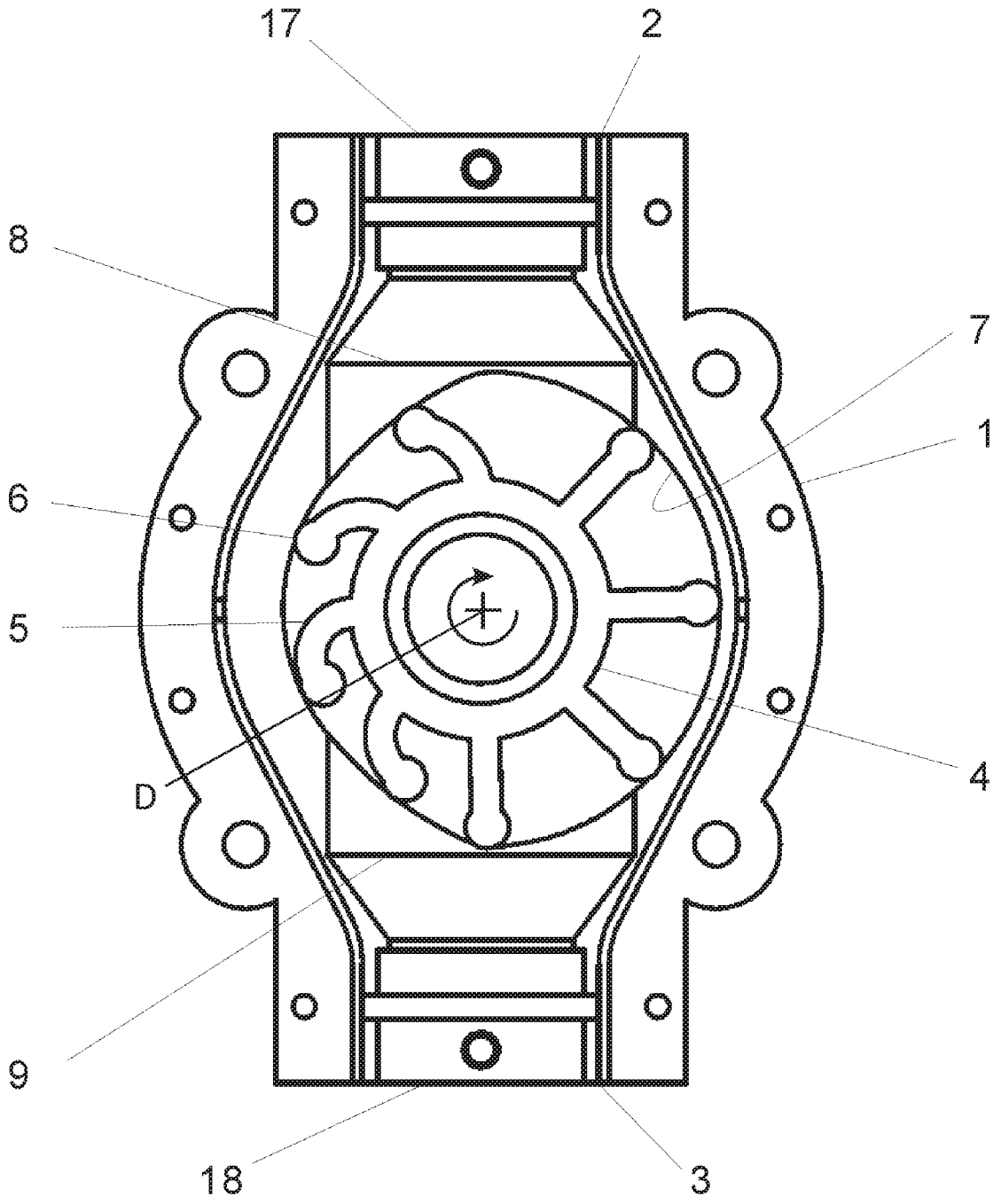
FIG. 1 schematically shows a sectional view of an impeller pump.

The operating principle of an impeller pump is readily visible from the illustration according to FIG. 1. The housing 1 of the impeller pump has an inlet 2 and an outlet 3. Mounted in the interior of the housing 1 so as to be rotatable about an axis of rotation D in the direction of the arrow is an impeller wheel 4. The impeller wheel 4 has a plurality of impeller blades 5, the blade ends 6 of which bear against the inner wall 7 of the housing 1. The interior of the housing 1 is not formed in a rotationally symmetrical manner about the axis of rotation D, but is shaped such that the impeller blades 5 are not deformed or are deformed only slightly on moving from the inlet opening 8 to the outlet opening 9, while they are bent counter to the direction of rotation of the impeller wheel 4 on moving from the outlet opening 9 to the inlet opening 8. As a result, the volume between two impeller blades 5 is greater on moving from the inlet opening 8 to the outlet opening 9 than the volume on moving from the outlet opening 9 to the inlet opening 8, with the result that the medium to be pumped is delivered from the inlet opening 8 to the outlet opening.

Figure 2:
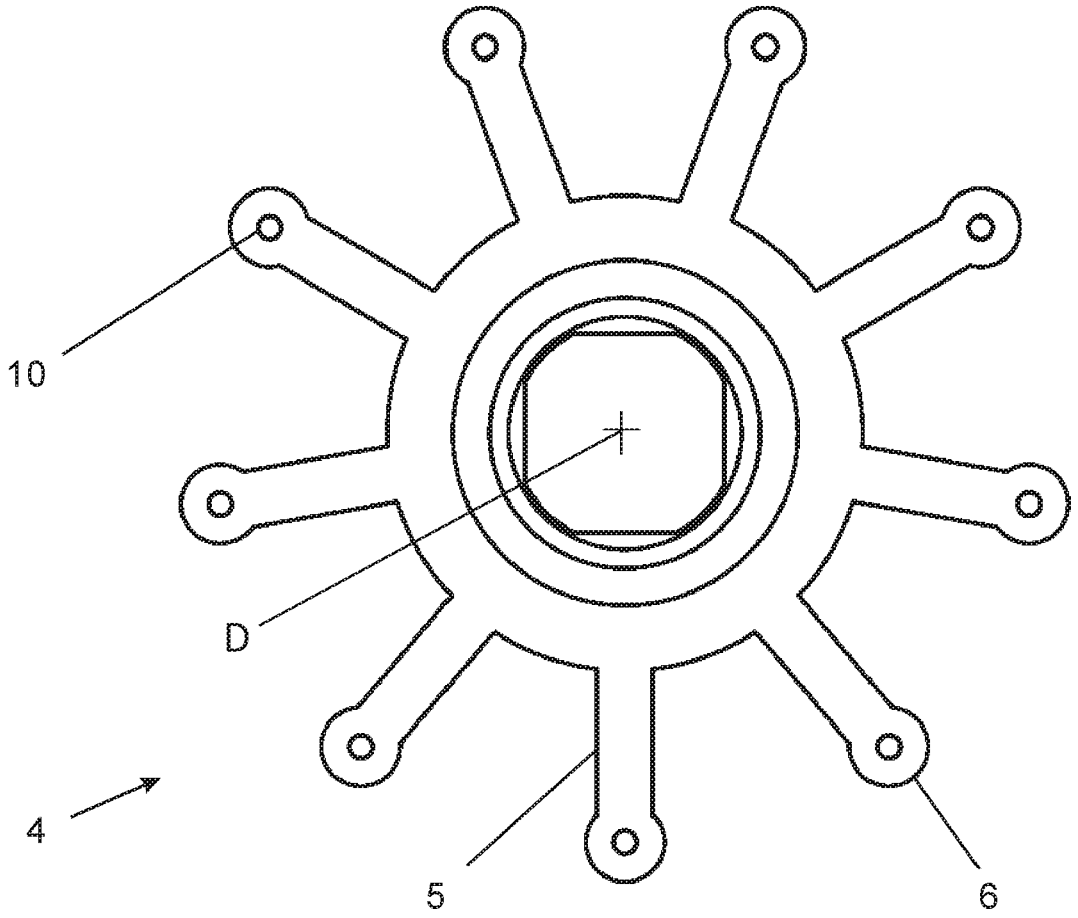
FIG. 2 schematically shows an impeller wheel.

FIG. 2 illustrates an impeller wheel 4, the impeller blades 5 of which are reinforced at their ends 6 by a wire 10 in order to minimize the deformation of the blade end 6 on sweeping over the inlet opening 8 and the outlet opening 9.

Figure 3:
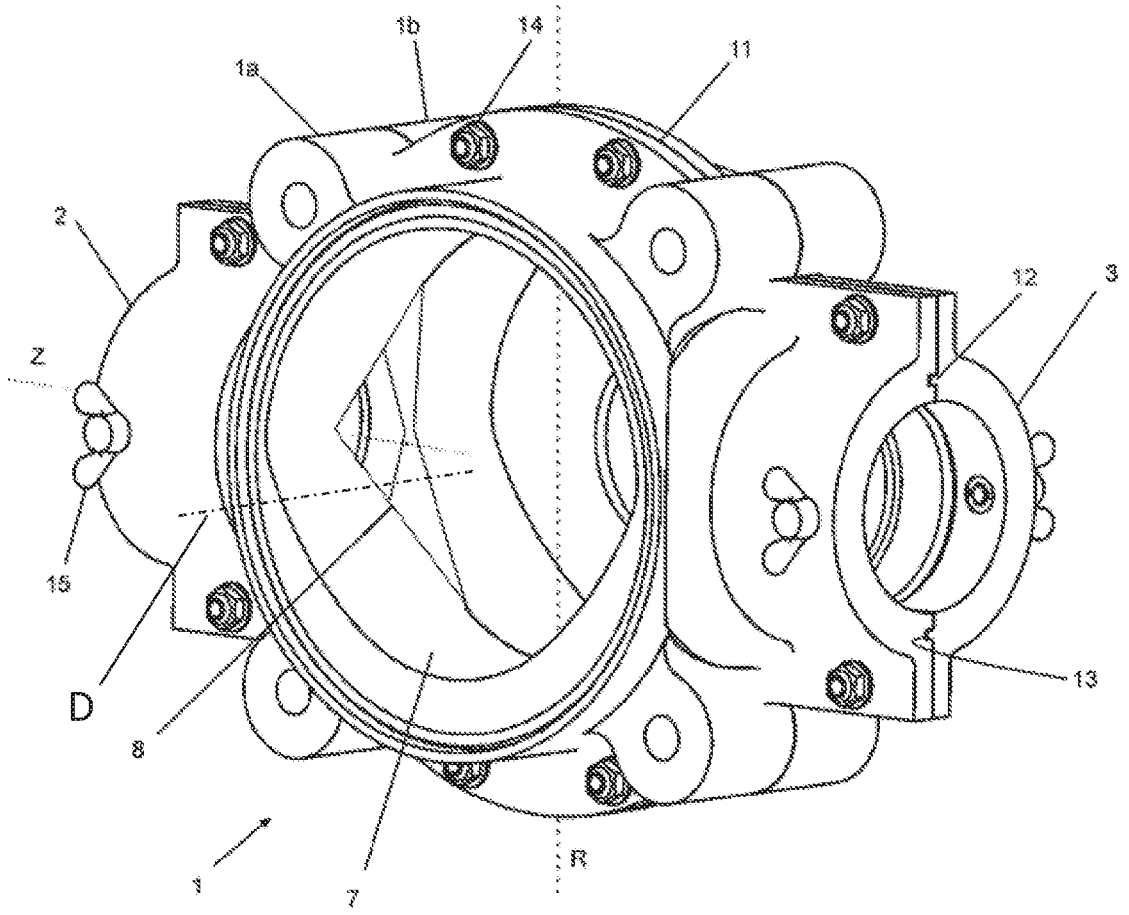
FIG. 3 schematically shows a perspective side view of a housing of an impeller pump.

FIG. 3 shows a perspective side view of the housing of an impeller pump. The housing 1 of the impeller pump is assembled from two parts 1*a*, 1*b*, which are axially symmetrical to one another with respect to the axis R, along a dividing plane 11. Protrusions 12 on one housing part 1*b*, which engage in corresponding recesses 13 in the other housing part 1*a* and thus make it easier to assemble the two housing parts 1*a*, 1*b*, in this case ensure a slight deviation of the contact faces between the two parts 1*a*, 1*b* from the dividing plane. The two housing parts 1*a*, 1*b* are held together by a plurality of screw connections 14. Between the two housing parts 1*a*, 1*b*, sealing elements can be provided, which can also take on the function of the protrusions 12 and recesses 13, when for example a sealing element engages in a groove formed in both housing parts.

The inlet opening 8 and the outlet opening (not shown) each have a cross section in the shape of a diamond-shaped polygon in this embodiment. As can also be seen from FIG. 3, the interior of the housing 1 of the impeller pump consists of a region in which the distance between the inner wall 7 and the axis of rotation D of the impeller wheel 4 is at a maximum, specifically when the impeller blades 5 move from the inlet opening 8 to the outlet opening 9. Furthermore, there is a region in which this distance is reduced, when the impeller blades 5 move from the outlet opening 9 to the inlet opening 8, in order to achieve deformation of the impeller blades 5.

The continuous transition from the region with the maximum distance to the region with the minimum distance starts at the level of the maximum transverse extent of the diamond of the inlet opening 8 or of the outlet opening 9, that is to say approximately in the middle of the inlet opening 8 or of the outlet opening 9. The housing 1 shown in FIG. 3 is illustrated without a side wall. Such a side wall can be produced separately from the two housing parts 1*a*, 1*b* and be connected to the corresponding housing part 1*a* for example by means of screwing or adhesive bonding. However, the housing part can also be produced with a side wall from the outset.

Clamping screws 15 at the inlet 2 and at the outlet 3 can be used to connect connection pipes to the inlet 2 or outlet 3 of the housing 1.

In FIG. 3 the elongate and narrow shape of the inlet opening 8 can also be seen, which has the result that the impeller blades 5 of the impeller wheel 4 (not illustrated in FIG. 3) are not pushed so greatly outwards and deformed by the occurring centrifugal forces on account of the rotation of the impeller wheel 4 and the elastic restoring forces on account of the deformation of the impeller blades 5, as in the case of impeller pumps in which the inlet opening extends over the entire width—or virtually the entire width—of the impeller blades and thus also of the housing interior. The outlet opening 9, which cannot be seen in FIG. 3, is generally formed identically to the inlet opening 8.

Although the shape of the inlet opening 8 in FIG. 3 appears to be irregular on account of the irregular curvature of the inner wall 7, the cross section of the inlet opening 8, i.e. the view of the inlet opening 8 from the housing interior along the axis Z defined by the inlet, is in the shape of a regular diamond. This can be readily seen in FIG. 4, which shows a section through an impeller pump along a plane E perpendicular to the axis Z defined by the inlet.

Figure 4:
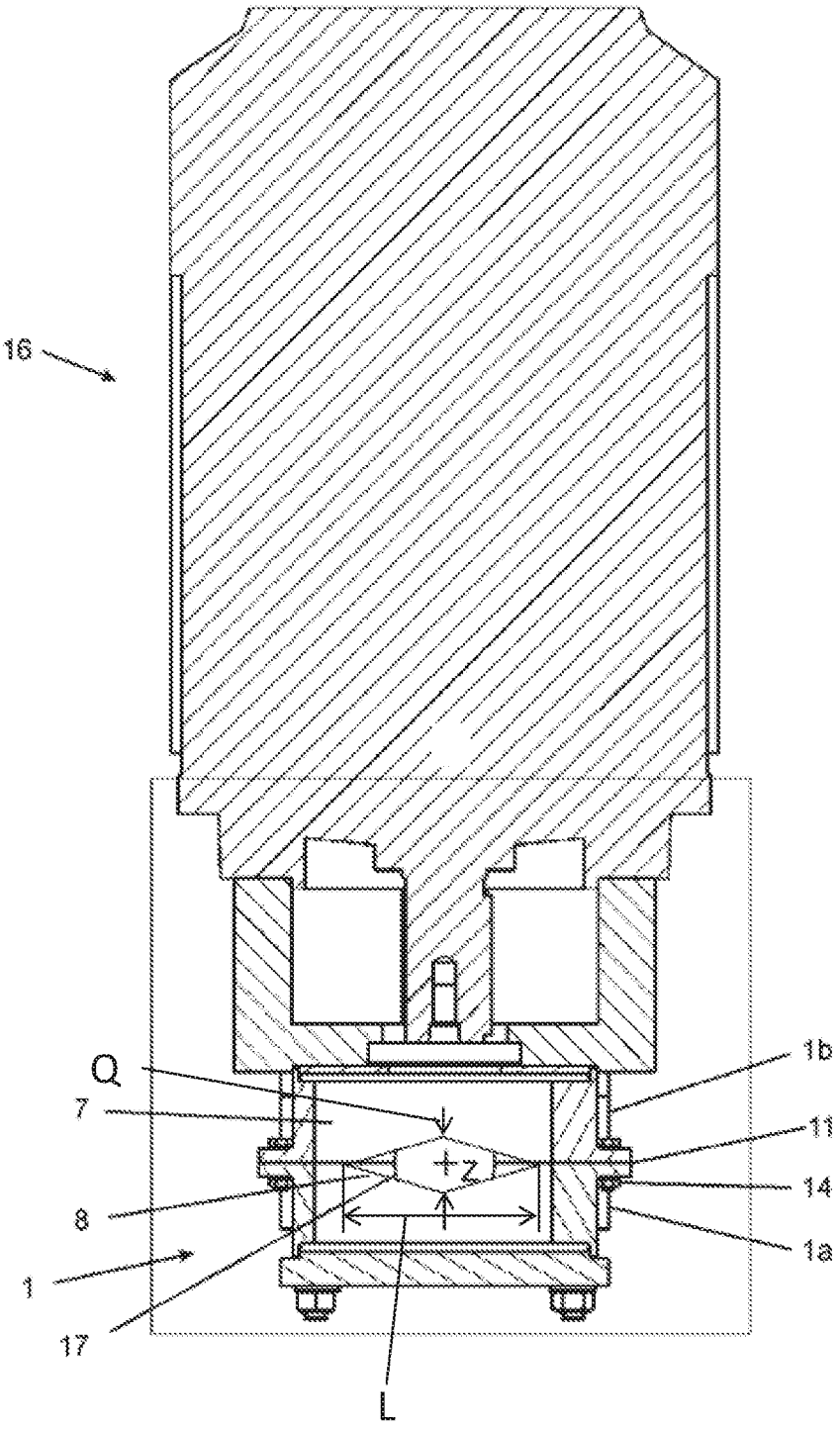
FIG. 4 schematically shows a further embodiment of an impeller pump.

FIG. 4 shows an embodiment of the impeller pump in which the housing 1 is connected to a drive unit 16 which drives the impeller wheel 4 (not illustrated). In this illustration, the diamond shape of the cross section of the inlet opening 8 can be readily seen. The longitudinal extent L of the polygon, which extends in the dividing plane 11 between the two housing parts 1*a*, 1*b*, is approximately three times as long as the transverse extent Q in this embodiment. The length of the transverse extent Q is about a third of the width of the inner wall 7 of the housing, i.e. approximately a third of the width of the impeller blades 5. The polygon includes a plurality of straight line segments, the longitudinal extent L is oriented perpendicular to the axis of rotation D, and the width of the polygon is oriented parallel to the axis of rotation D. Widths of the cross section vary along at least a part of the longitudinal extent.

Figure 5:
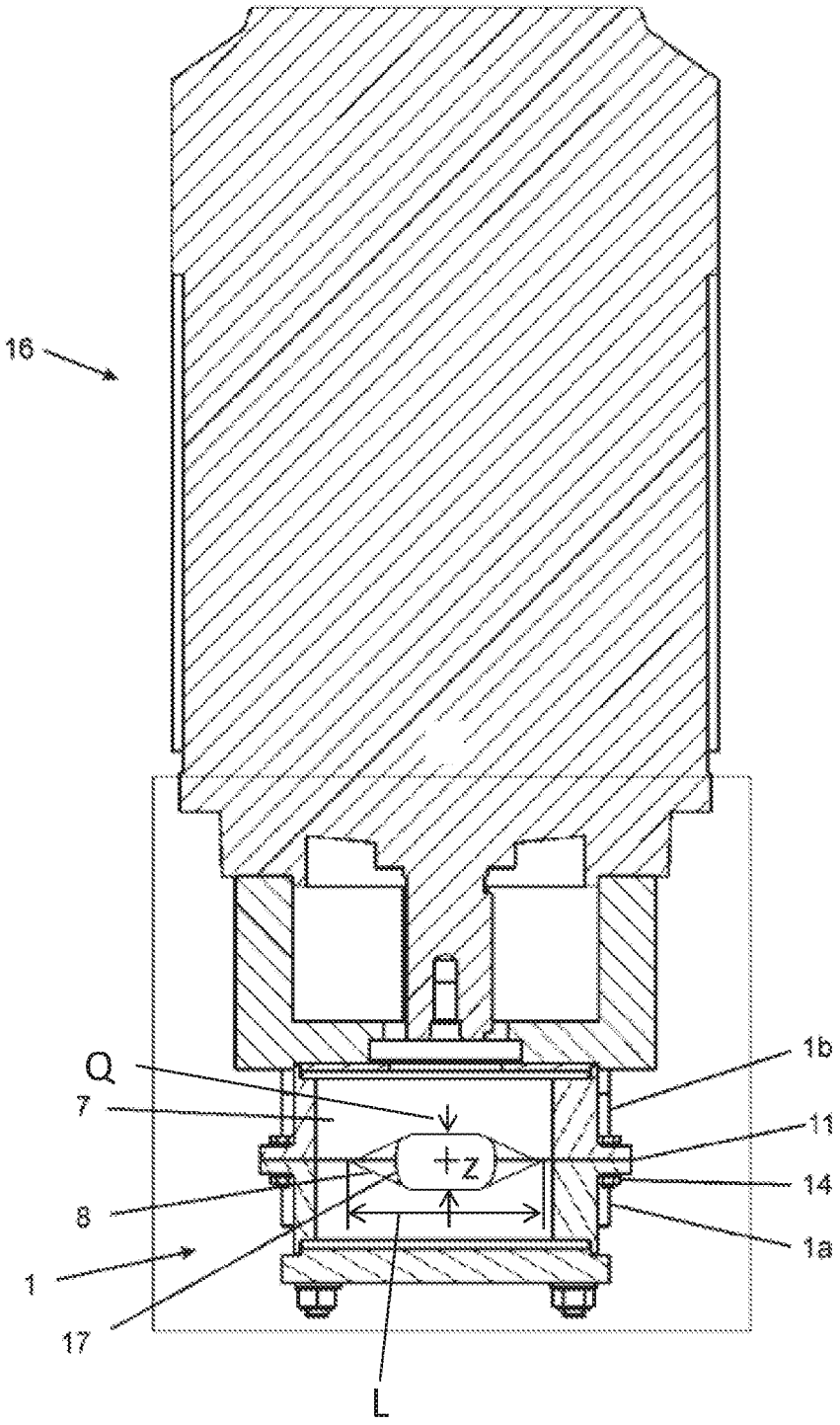
FIG. 5 schematically shows a further embodiment of an impeller pump with a cross section in the shape of a polygon with six corners.

The embodiment of the impeller pump that is shown in FIG. 5 corresponds substantially to the one in FIG. 4, wherein the shape of the cross section is a polygon with six corners. The longitudinal extent L of the polygon, which extends in the dividing plane 11 between the two housing parts 1*a*, 1*b*, is approximately three times as long as the transverse extent Q in this embodiment. Compared to the cross section in FIG. 4, the cross section in FIG. 5 has a larger cross-sectional area, such that, under identical pressure conditions during pump operation, a greater volumetric flow can be delivered. The polygon includes a plurality of straight line segments, the longitudinal extent L is oriented perpendicular to the axis of rotation D, and the width of the polygon is oriented parallel to the axis of rotation D. Widths of the cross section vary along at least a part of the longitudinal extent.

Figure 6:
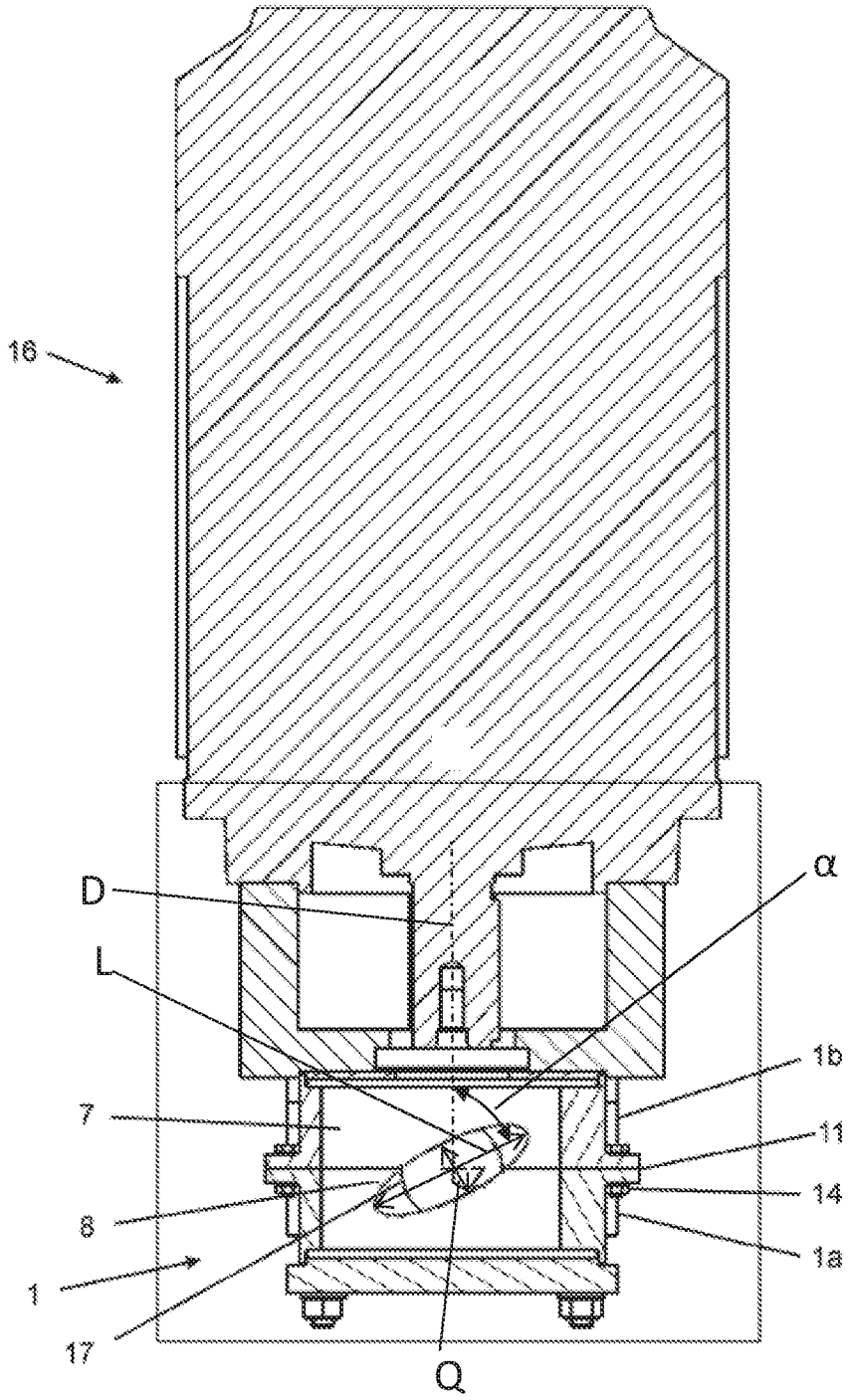
FIG. 6 schematically shows a further embodiment of an impeller pump, the longitudinal extent of the inlet-opening cross section of which encloses an angle with the axis of rotation of the impeller wheel on a plane defined by the cross section.

FIG. 6 shows a further embodiment of an impeller pump, the structure of which corresponds substantially to that of the impeller pumps shown in FIGS. 3 to 5. The impeller pump shown in FIG. 6 also has an inlet which has, on the side facing the housing interior, a cross section with a longitudinal extent L and a transverse extent Q, wherein the longitudinal extent L encloses an angle $\alpha$ with the axis of rotation D of the impeller wheel (not shown). In the present case, the angle $\alpha$ is 60°.

The cross section of the inlet opening 8 in FIG. 6 is in the shape of an ellipse.

However, alternatively, the angle $\alpha$ can also have other values, for example 5°, 10°, 15°, 20°, 25°, 30°, 35°, 40°, 45°, 50°, 55°. 60°, 65°, 70°, 75°, 80°, or 85°, and be arranged in a positive and a negative direction of rotation.

Generally, the longitudinal extent L of the inlet opening 8 and the longitudinal extent of the outlet opening 9 are arranged in a parallel manner. Alternatively, the two longitudinal extents can also be oriented in different manners.

Figure 7:
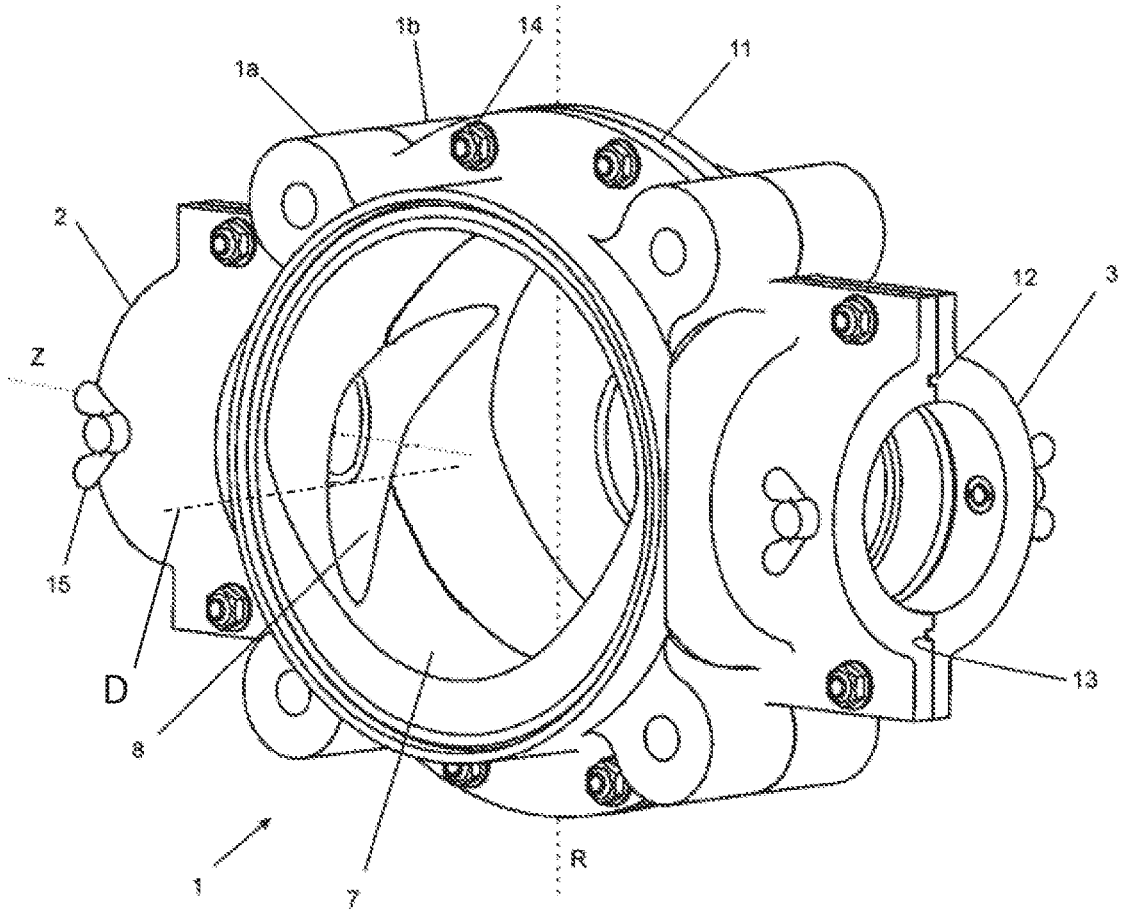
FIG. 7 shows the impeller pump from FIG. 6 in a schematic perspective side view.

FIG. 7 shows the impeller pump from FIG. 6 in a schematic perspective side view. It is readily apparent here that, on moving along the inlet opening 8, an impeller blade comes into contact with the edges of the inlet opening 8 initially in the region of its one end. As the impeller blades continue to move, the contact points between the impeller blade and the edges of the inlet opening 8 move along the impeller blade into the region of the other end of the impeller blade. Therefore, after moving over the inlet opening 8, the impeller blade has come into contact with the edges of the inlet opening 8 substantially across its entire width, wherein the contact points have moved continuously. Since, as can be gathered from the detail in FIG. 23, the cross-sectional width b of the cross section parallel to the width of the impeller blade is only insignificantly wider than the transverse extent Q on account of the narrow, elongate form of the cross section, deformation of the impeller blade on moving over the inlet opening is limited to a minimum. Therefore, the impeller blade undergoes even and only slight wear substantially over its entire width, thereby allowing a long service life of the impeller wheel used.

Figure 8:
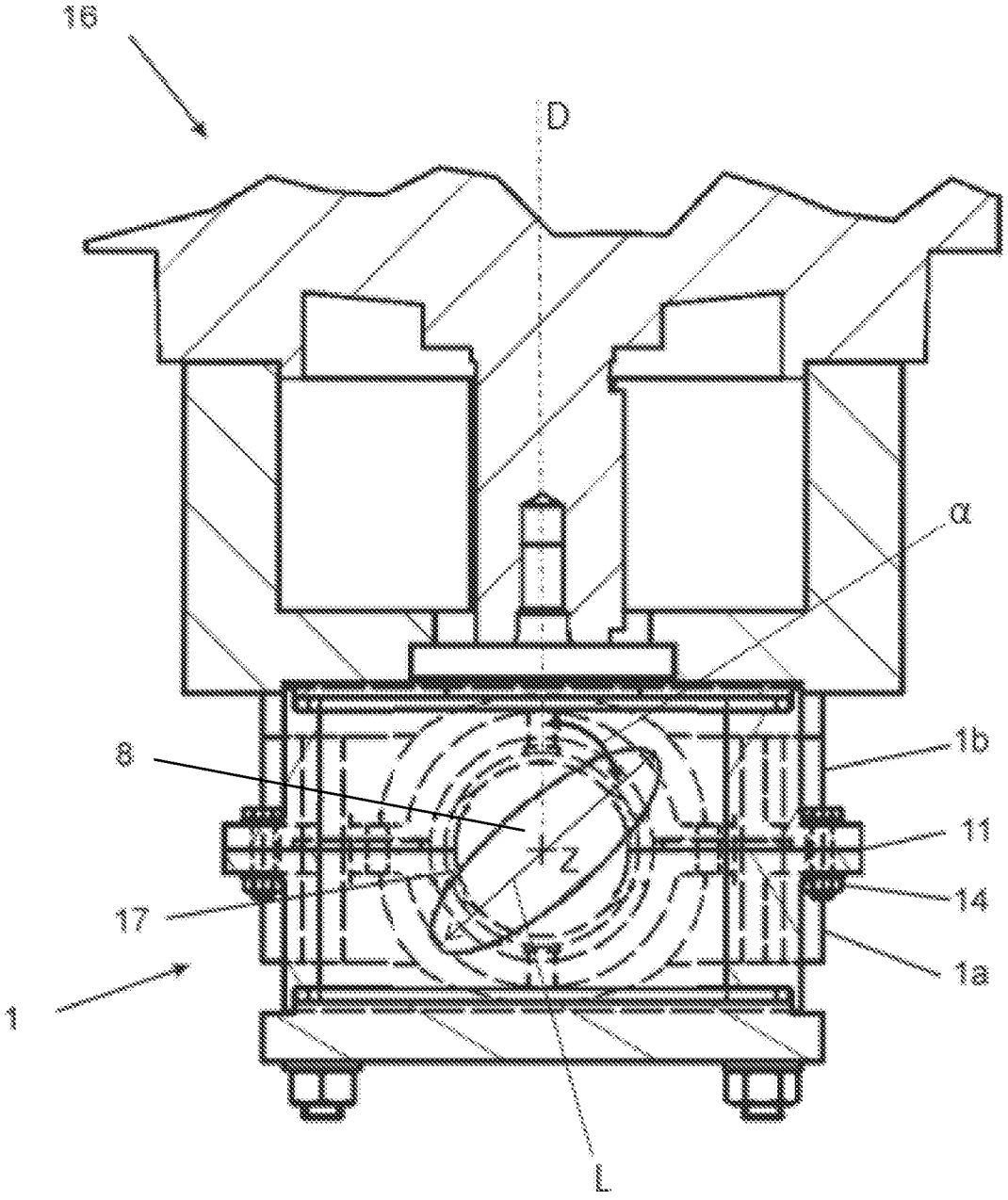
FIG. 8 shows a schematic side view of an impeller pump in a further embodiment.

FIG. 8 shows a schematic sectional view of an impeller pump in a further embodiment. The longitudinal extent L forms an angle $\alpha$ of 45° with the axis of rotation D in this case.

In the embodiments of the impeller pump that are illustrated in the figures, the inlet 2 and the outlet 3 are in the shape of a circle at their outer ends facing away from the housing interior, in order for it to be possible to connect normal, round connection pipes easily to the inlet 2 and the outlet 3.

In this regard, it is readily apparent from FIG. 8 that the area of the circle of the outer inlet opening 17 and the cross section of the inner inlet opening 8 are approximately the same size, in order to allow uniform transport of the medium to be pumped.

In the embodiment shown in FIG. 8, the circular cross section at the outer end, facing away from the housing interior, transitions to the elliptical cross section of the inlet opening 8 gradually, and thus without abrupt changes in the cross-sectional profile along the axis Z.

FIGS. 9 to 25 schematically depict different embodiments of the cross section for the inlet and/or the outlet with their respective longitudinal extents L and their respective transverse extents Q.

Figure 9:
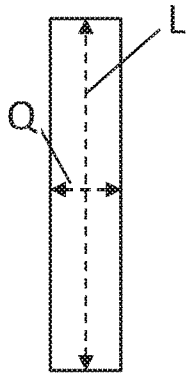
FIGS. 9-22 schematically show different polygonal embodiments of cross sections of the inlet or outlet.

The cross section schematically illustrated in FIG. 9 is a polygon in the shape of an elongated rectangle, such that an inlet with the shape of a rectangular oblong hole is formed.

Figure 10:
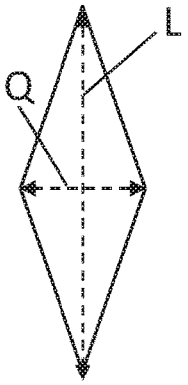

The cross section schematically illustrated in FIG. 10 is a polygon in the shape of a regular diamond. The transverse extent Q and the longitudinal extent L therefore intersect in each case at their central points.

Figure 11:
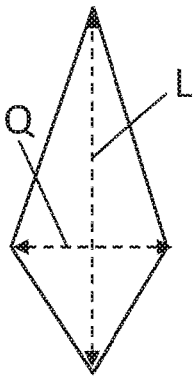

The cross section schematically illustrated in FIG. 11 is a polygon in the shape of a diamond, in which the transverse extent Q divides the longitudinal extent L in a ratio of 2:1.

Figure 12:
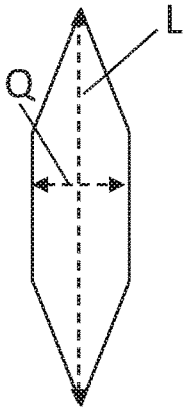

The cross section schematically illustrated in FIG. 12 is a polygon in the shape of a hexagon.

Figure 13:
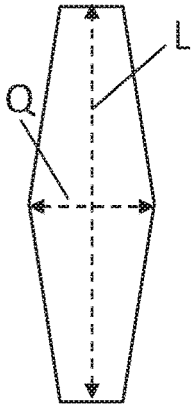

The cross section schematically illustrated in FIG. 13 is a polygon in the shape of a further hexagon.

Figure 14:
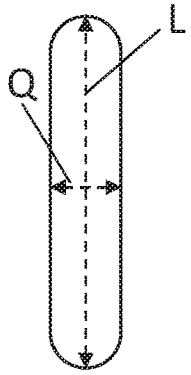

The cross section schematically illustrated in FIG. 14 corresponds to the one in FIG. 9, wherein the corners of the cross section are rounded so as to produce a rounded oblong hole. The radii of the roundings are selected in this case such that semicircular ends are formed.

Figure 15:
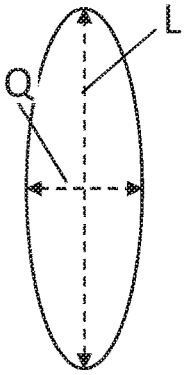

The cross section schematically illustrated in FIG. 15 is in the shape of an ellipse. This is created in this case by rounding the corners of the polygon in FIG. 10.

Figure 16:
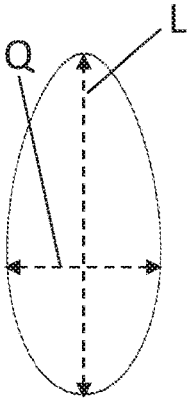

The cross section schematically illustrated in FIG. 16 corresponds to the one in FIG. 11, wherein the corners are rounded such that the cross section has an "egg-shaped" shape.

Figure 17:
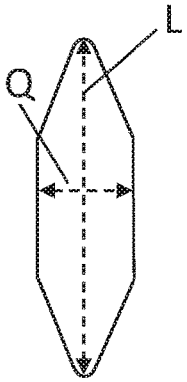

The cross section schematically illustrated in FIG. 17 corresponds to the one in FIG. 12, wherein the corners located at the two ends as seen in the longitudinal extent L are rounded.

Figure 18:
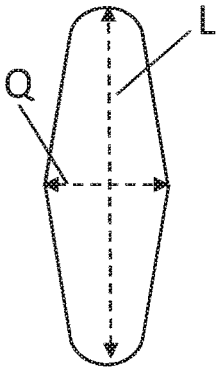

The cross section schematically illustrated in FIG. 18 corresponds to the one in FIG. 13, wherein the corners located at the two ends as seen in the longitudinal extent L are rounded, such that a single rounding has been produced at each of the corners.

Figure 19:
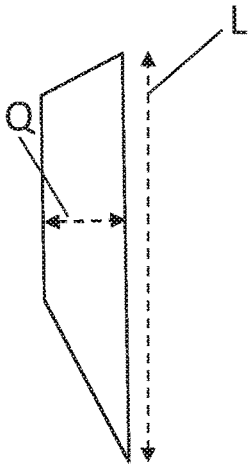

The cross section schematically illustrated in FIG. 19 is a quadrilateral polygon, in which the longitudinal extent L coincides with the longest edge of the polygon.

Figure 20:
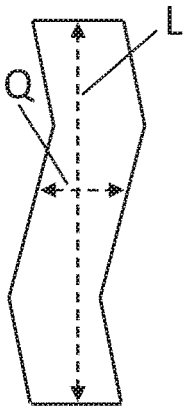

The cross section schematically illustrated in FIG. 20 is an octagonal polygon, the transverse extent Q of which is constant as seen along the longitudinal extent L.

Figure 21:
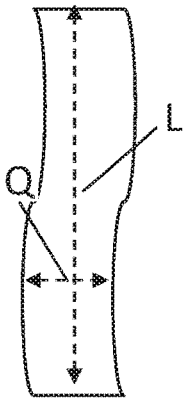

The cross section schematically illustrated in FIG. 21 corresponds to the one in FIG. 20, wherein the edges which have a component in the longitudinal extent L have different curvatures, such that a polygon with four corners has been produced, wherein an edge curved in an S shape has been formed from in each case three edges of the cross section in FIG. 20.

In the cross sections shown in FIGS. 9 to 21, the longitudinal extent L and the transverse extent Q are each oriented perpendicularly to one another.

As a rule, the longitudinal extent in these embodiments is arranged perpendicularly to the axis of rotation D. In the cross sections shown in FIGS. 9 to 21, the transverse extent Q extends accordingly parallel to the axis of rotation D of the impeller wheel. Alternatively, the longitudinal extent L and axis of rotation D can also enclose an angle.

Figure 22:
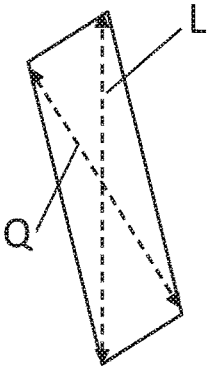

The cross section schematically illustrated in FIG. 22 is a quadrilateral polygon in which the longitudinal extent L and the transverse extent Q are oriented at an angle other than 90°.

Figure 23:
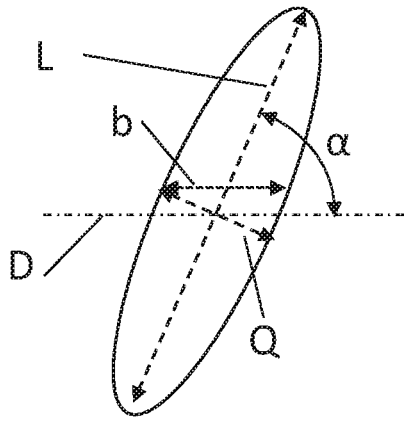
FIGS. 23-25 schematically show different embodiments of cross sections, the longitudinal extent of which encloses an angle with the axis of rotation of the impeller wheel.
Figure 24:
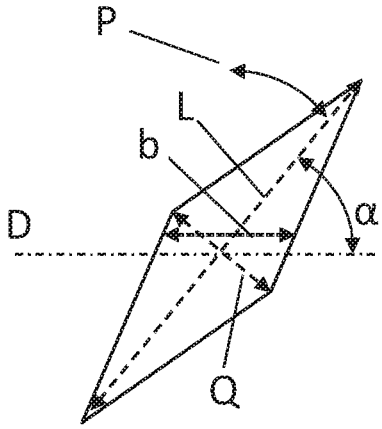
Figure 25:
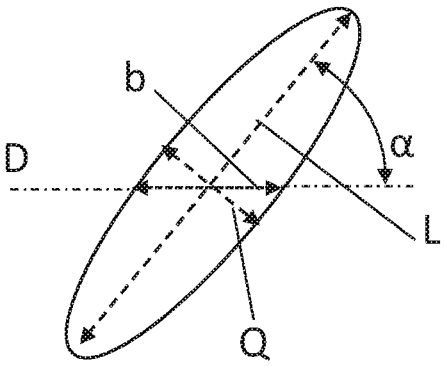

FIGS. 23 to 25 depict schematically illustrated cross sections of the inlet opening or of the outlet opening, in which the longitudinal extent L encloses an angle $\alpha$ with the axis of rotation D.

The cross section schematically shown in FIG. 23 is in the shape of an ellipse. Therefore, the longitudinal extent L coincides with the major axis of the ellipse and the transverse extent Q coincides with the minor axis of the ellipse. The angle $\alpha$ is about 60° in the present case. The reference sign b indicates the cross-sectional width parallel to the width of the impeller blades, and thus perpendicular to the axis of rotation D. This cross-sectional width b corresponds to that part of the impeller blade that does not come into contact with the housing wall during a movement along the opening. On account of the elliptical shape of the cross section, the cross-sectional width b varies depending on the position of the impeller blade at the opening defining the cross section.

The cross section schematically shown in FIG. 24 is in the shape of a diamond. The angle $\alpha$ is about 45° in the present case. As a result of the specific configuration of the cross section, the transverse extent Q and the maximum cross-sectional width b, oriented thereto at an angle of accordingly likewise 45°, have more or less the same vector length.

The cross section schematically illustrated in FIG. 25 corresponds to the one in FIG. 23, wherein the angle $\alpha$ is about 45° in the present case.

Where applicable, all the individual features which are illustrated in the exemplary embodiments can be combined and/or exchanged for one another, without departing from the scope of the invention.

What is claimed is:

1. An impeller pump comprising:

a housing comprising:

an inlet comprising an opening consisting of one inner inlet opening at which the inlet transitions into an interior of the housing, and an outlet comprising an opening consisting of one inner outlet opening at which the outlet transitions into the interior of the housing; and an impeller wheel disposed in the interior of the housing, rotatable about an axis of rotation, and comprising a plurality of elastic impeller blades, wherein a cross section of at least one of the inner inlet opening or of the inner outlet opening when viewed from the interior of the housing along an axis defined by the at least one of the inlet or the outlet is in a shape of a polygon comprising a plurality of straight line segments, a longitudinal extent that is oriented perpendicular to the axis of rotation, and a width of the cross section that is oriented parallel to the axis of rotation, wherein widths of the cross section vary along at least a part of the longitudinal extent.

2. The impeller pump of claim 1, wherein the polygon further comprises a transverse extent, and a ratio of a length of the transverse extent to a length of the longitudinal extent is less than or equal to 1:2.

3. The impeller pump of claim 2, wherein the ratio of the length of the transverse extent to the length of the longitudinal extent is 1:3 or 1:4.

4. The impeller pump of claim 2, wherein the polygon is symmetrical with respect to at least one of the longitudinal extent or the transverse extent.

5. The impeller pump of claim 2, wherein a ratio of the length of the transverse extent to a width of the impeller blades is less than 1:1.

6. The impeller pump of claim 5, wherein the ratio of the length of the transverse extent to the width of the impeller blades is 1:3 or 1:4.

7. The impeller pump of claim 1, wherein the polygon has at least one rounded corner.

8. The impeller pump of claim 1, wherein a cross section of at least one of the inner inlet opening or of the inner outlet opening on a side facing away from the interior of the housing is in a shape of a circle or the shape of a polygon.

9. The impeller pump of claim 8, wherein at least one of the cross section of the inner inlet opening or of the inner outlet opening on the side facing away from the interior of the housing is in a shape of a square.

10. An impeller pump comprising:

a housing comprising:

an inlet comprising an opening consisting of one inner inlet opening at which the inlet transitions into an interior of the housing, and an outlet comprising an opening consisting of one inner outlet opening at which the outlet transitions into the interior of the housing; and an impeller wheel disposed in the interior of the housing, rotatable about an axis of rotation, and comprising a plurality of elastic impeller blades, wherein a cross section of at least one of the inner inlet opening or of the inner outlet opening on a side facing the interior of the housing has a longitudinal extent and a transverse extent, a length of the longitudinal extent is greater than a length of the transverse extent, and the longitudinal extent of the cross section encloses an angle with the axis of rotation.

11. The impeller pump of claim 10, wherein the angle is greater than 0° and less than 90°.

12. The impeller pump of claim 11, wherein the angle is greater than or equal to 30° and less than or equal to 60°.

13. The impeller pump of claim 10, wherein the cross section of at least one of the inner inlet opening or of the inner outlet opening is in a shape of an ellipse or a polygon.

14. The impeller pump of claim 13, wherein the polygon comprises at least one rounded corner.

15. The impeller pump of claim 10, wherein a ratio of the length of the transverse extent to a width of the impeller blades is less than 1:1.

16. The impeller pump of claim 15, wherein the ratio of the length of the transverse extent to the width of the impeller blades is less than or equal to 1:2.

17. The impeller pump of claim 10, wherein a ratio of a width of the impeller blades to a cross-sectional width of the cross section of at least one of the inner inlet opening or of the inner outlet opening parallel to the width of the impeller blades is greater than or equal to 3:2.

18. The impeller pump of claim 10, wherein a cross section of at least one of the inner inlet opening or of the inner outlet opening on a side facing away from the interior of the housing is in a shape of a circle or a shape of a polygon.

19. The impeller pump of claim 18, wherein the polygon comprises a rectangle.

20. The impeller pump of claim 10, wherein at least one edge of at least one of the inner inlet opening or of the inner outlet opening comprises a chamfer or is rounded at a transition to the interior of the housing.

* * * * *